US011407584B2

(12) United States Patent
Chen

(10) Patent No.: US 11,407,584 B2
(45) Date of Patent: Aug. 9, 2022

(54) INDUCTIVE COVER ASSEMBLY AND TRASH CAN HAVING SAME

(71) Applicant: EKO GROUP LTD, Guangdong (CN)

(72) Inventor: Yizhi Chen, Guangdong (CN)

(73) Assignee: EKO GROUP LTD, Guangzhou (CN)

( * ) Notice: Subject to any disclaimer, the term of this patent is extended or adjusted under 35 U.S.C. 154(b) by 93 days.

(21) Appl. No.: 17/139,818

(22) Filed: Dec. 31, 2020

(65) Prior Publication Data

US 2021/0221610 A1 Jul. 22, 2021

(30) Foreign Application Priority Data

Jan. 22, 2020 (CN) ..... 202010077344.8

(51) Int. Cl.
*B65F 1/16* (2006.01)
*B65F 1/06* (2006.01)

(52) U.S. Cl.
CPC ..... *B65F 1/1638* (2013.01); *B65F 1/06* (2013.01); *B65F 1/1646* (2013.01); *B65F 2210/168* (2013.01)

(58) Field of Classification Search
CPC ..... B65F 1/1638; B65F 1/06; B65F 1/1646; B65F 2210/168
USPC ..... 220/211
See application file for complete search history.

(56) References Cited

U.S. PATENT DOCUMENTS 8,678,219 B1 * 3/2014 Wang ..... B65F 1/1638 220/264
2009/0194532 A1 * 8/2009 Yang ..... B65F 1/1638 220/211
2011/0017735 A1 * 1/2011 Wang ..... B65F 1/1638 220/211
2013/0233853 A1 * 9/2013 Yang ..... B65F 1/02 220/211
2013/0233857 A1 * 9/2013 Yang ..... B65F 1/04 220/495.08
2014/0238986 A1 * 8/2014 Crawford ..... B65F 1/1638 220/211
2015/0259140 A1 * 9/2015 Yang ..... E05F 15/73 220/211
2019/0152698 A1 5/2019 Zhao
2020/0115158 A1 * 4/2020 Wang ..... B65F 1/06
2022/0097960 A1 * 3/2022 Yang ..... G01D 5/16

FOREIGN PATENT DOCUMENTS

CN 207258493 U 4/2018
WO 2018133184 A1 7/2018

* cited by examiner

*Primary Examiner* — J. Gregory Pickett
*Assistant Examiner* — Niki M Eloshway

(57) ABSTRACT

An inductive cover assembly is configured to connect a can body of a trash can. A side of the can body is provided with an assembly groove extending downward. The inductive cover assembly includes an insert, and an inductive ring and a cover that are hinged to the insert. The assembly groove and the insert are pluggably connected, so as to allow the inductive cover assembly detachably arranged on the can body. Therefore, there is no need to remove the inductive cover assembly during the replacement of trash bags.

10 Claims, 11 Drawing Sheets

INDUCTIVE COVER ASSEMBLY AND TRASH CAN HAVING SAME

CROSS-REFERENCE TO RELATED APPLICATIONS

This application claims the benefit of priority from Chinese Patent Application No. 202010077344.8, filed on Jan. 22, 2020. The content of the aforementioned application, including any intervening amendments thereto, is incorporated herein by reference in its entirety.

TECHNICAL FIELD

The application relates to trash cans, and more particularly to an inductive cover assembly and a trash can having the same.

BACKGROUND

As a basic household item, trash cans currently tend to be diversified due to the improvement of the quality of life. The trash can is often provided with a cover or a door to prevent the overflow of the trash and the diffusion of the odor and to hide the trash in the trash can. The cover on the trash can is often automatically opened through inductions or manually opened. The automatic method is to control motors to open the cover of the trash can through the inductive technology.

Generally, the trash can has an inner container and a body which are detachable. The inner container is configured to contain trash, and a trash bag is usually put in the inner container to contain the trash, so as to avoid direct contact of the trash and the inner container. This allows the inner container to be clean, thus reducing the cleaning frequency of the inner container. An edge of the trash bag is fixed by a cover of the trash can to prevent the slippage of the trash bag and ensure that the trash bag is open, so that the trash can be thrown into the bag. In the existing inductive trash cans, the actuating assembly is arranged on the top ring or the body of the trash can, which increases the thickness of the opening ring or the body of the trash can, and thus the trash can has a clumpy appearance. In addition, the body and the cover of the existing inductive trash can are generally detachable, that is, the cover is directly put on the body. The cover is detached firstly from the body for replacing the trash bags in the trash can, and then the cover is put on the body of the trash can again after the replacement, resulting in a complex replacement process.

SUMMARY

In view of the problems in the prior art, the disclosure aims to provide an inductive cover assembly and a trash can having the same, in which the actuating assembly is arranged in the insert of the inductive cover component, so as to reduce the thickness of the inductive ring or the can body of the trash can, and make the trash can simple and fashionable. In addition, the inductive cover assembly is pluggably connected to the can body of the trash can through the insert, and is rotatable respect to the can body. In this way, there is no need to remove the inductive cover assembly during the replacement of trash bags.

The present disclosure provides an inductive cover assembly, the inductive cover assembly operable to be connected to a can body of a trash can, a side of the can body being provided with an assembly groove extending downward, the inductive cover assembly comprising:

an insert, comprising a casing and an actuating assembly arranged in the casing, wherein the insert is pluggably connected to the assembly groove to allow the inductive cover assembly to be detachably arranged on the can body;

an inductive ring; having a first opening and hinged to the insert; and a cover; covering the first opening of the inductive ring and hinged to the insert;

wherein the casing of the insert is detachably arranged on the can body and comprises an insert end and a hinge end; the insert end is arranged at a lower end of the hinge end, and is detachably arranged in the can body; the hinge end is hinged to the inductive ring and the cover, respectively, and a hinge axis of the hinge end and the inductive ring is the same as that of the hinge end and the cover; the inductive ring and the cover are rotatable with respect to the insert; the inductive ring is arranged between the cover and the can body, and an angle of the inductive ring with respect to the insert is limited by a position of the cover; the inductive ring is turned to a preset angle to open the inductive ring;

the actuating assembly comprises a power supply module, an actuating unit, a speed reducer and a connector that are arranged in the insert; the power supply module is connected to the actuating unit through a control circuit board, and is configured to supply power for the actuating unit; the control circuit board is configured to control the actuating unit to rotate; an input shaft of the speed reducer is connected to an output shaft of the actuating unit; an end of the connector is connected to an output shaft of the speed reducer, and the other end of the connector is connected to the cover; the actuating unit drives the connector to rotate through the speed reducer, so that the cover is driven to rotate around the insert;

the inductive ring is provided with an inductive circuit which extends along a circumference of the inductive ring and is connected to the control circuit board; the inductive circuit comprises a plurality of inductive elements which are configured to identify a signal for opening or closing the cover and transmit the signal to the control circuit board; and the control circuit board controls the actuating unit to rotate according to the signal identified by the inductive elements.

In some embodiments, the inductive cover assembly further comprises a hinge shaft, a hinge seat, and a plurality of hinge blocks; wherein the hinge shaft is arranged on the hinge end of the insert; the cover is connected to the hinge seat which is rotatably connected to the hinge shaft, so that the cover is rotatable around the hinge shaft; the inductive ring is connected to the hinge blocks which are rotatably connected to the hinge shaft, so that the inductive ring is rotatable around the hinge shaft; and the hinge blocks are arranged at both ends of the hinge seat.

In some embodiments, the first opening of the inductive ring fits the cover in shape; an end of the inductive ring close to the insert is provided with a through hole penetrating through upper and lower surfaces of the inductive ring; an end of the hinge seat away from the insert passes through the through hole and is fixedly connected to the cover, so that the inductive ring and the cover are hinged to the hinge end of the insert, respectively; a notch is provided on an end of the hinge seat close to the insert, and a connecting shaft is provided in the notch along a length of the hinge seat; and an end of the connector away from the actuating unit extends into the notch and is hinged to the connecting shaft.

In some embodiments, a fixing block is provided on the hinge end, and an upper end of the fixing block is provided with a fixing part; the fixing part is respectively connected to the hinge shaft to fix the hinge shaft on the hinge end of the insert; a blocking part that is arranged along the length of the hinge seat is provided on a side of the fixing block close to the hinge block; a locating part is provided on a side of the hinge block close to the blocking part along a rotation direction of the hinge block; and the inductive ring rotates around the hinge shaft, and when the locating part is connected to the blocking part, the inductive ring is opened.

In some embodiments, the hinge shaft extends horizontally, and the fixing part is provided with a connecting hole along a length of the hinge shaft; the connecting hole penetrates through the fixing part, and an end of the hinge shaft extends into the connecting hole to connect the fixing part; an end of the inductive ring close to the insert is provided with a connecting groove corresponding to the fixing part, and the connecting groove is provided with a second opening extending horizontally; the fixing part extends into the connecting groove and is rotatably connected to the inductive ring, and the connecting hole is communicated to the connecting groove; an inner wall of the connecting hole is provided with a threading hole communicated to an external environment; and the control circuit board is arranged in the insert, and the inductive circuit is arranged circumferentially around the inductive ring and passes through the connecting groove, the connecting hole and the threading hole in sequence, and then is connected to the control circuit board arranged in the insert.

In some embodiments, a recessed groove is provided on a side wall or two opposite side walls of the assembly groove, and the recessed groove is communicated to the assembly groove; and an upper surface of the can body is provided with a slide hole corresponding to the recessed groove, and the slide hole is communicated to the recessed groove.

In some embodiments, a locking member is provided on an inner surface of the recessed groove; the locking member is a locating pin provided with a toggle block which passes through the slide hole and extends out of the can body; the toggle block drives the locating pin to move along the slide hole with respect to the recessed groove; the insert is provided with a locating groove corresponding to the locating pin; and when the locating pin moves towards the assembly groove and a long end face of the toggle block abuts against the slide hole, the slide hole restricts the forward movement of the locating pin, and the locating pin is inserted into the locating groove.

In some embodiments, the power supply module and the control circuit board are arranged in the insert; and the actuating unit is arranged on a side of the control circuit board and is electrically connected to the control circuit board.

In some embodiments, a push block which is cylindrical is arranged on an output shaft of the speed reducer, and an end of the push block close to the speed reducer is provided with a connecting part and a mounting part; the connecting part and the mounting part extend in opposite directions from a circumference of the push block; and the connector is in transmission connection with the connecting part, and a torsion spring is arranged on the push block and configured to offset the gravity during the turning of the cover.

The present disclosure further provides a trash can having the inductive cover assembly, comprising a main body; wherein the inductive cover assembly is detachably arranged on the main body;

the main body comprises a can body and an inner container;

the can body is provided with a first cavity that comprises a third opening on an upper end surface; the inner container is arranged in the first cavity of the can body through the third opening, and an upper end of the inner container protrudes from that of the can body; the inner container is provided with a second cavity for accommodating trash and a fourth opening, and the fourth opening is communicated to the inner cavity and is located at the upper end of the inner container; and the trash enters the second cavity through the fourth opening; and the assembly groove having a fifth opening that is arranged upward is arranged on an upper end of the can body; and the casing of the insert is inserted into the assembly groove through the fifth opening.

Compared to the prior art, the present invention has the following beneficial effects.

1. The inductive cover assembly of the present invention is connected to a can body of a trash can, and a side of the can body is provided with an assembly groove extending downward. The inductive cover assembly comprises an insert, an inductive ring and a cover that are hinged to the insert along a same axis. The assembly groove is pluggably connected to the insert, so that the inductive cover assembly can be detachably arranged on the can body of the trash can.

When the inductive ring is turned upward to the maximum angle, the inductive ring is opened. This facilitates the replacement of the trash bag. After the replacement, the inductive ring can be turned downward to connect the can body of the trash can, which is convenient to use. In this way, there is no need to remove the inductive cover assembly during the replacement of trash bags.

2. The actuating assembly of the invention is arranged in the insert instead of the inductive ring or the can body of the trash can, which reduces the thickness of the inductive ring or the can body of the trash can. This makes the trash can simple and fashionable.

Figure 1:
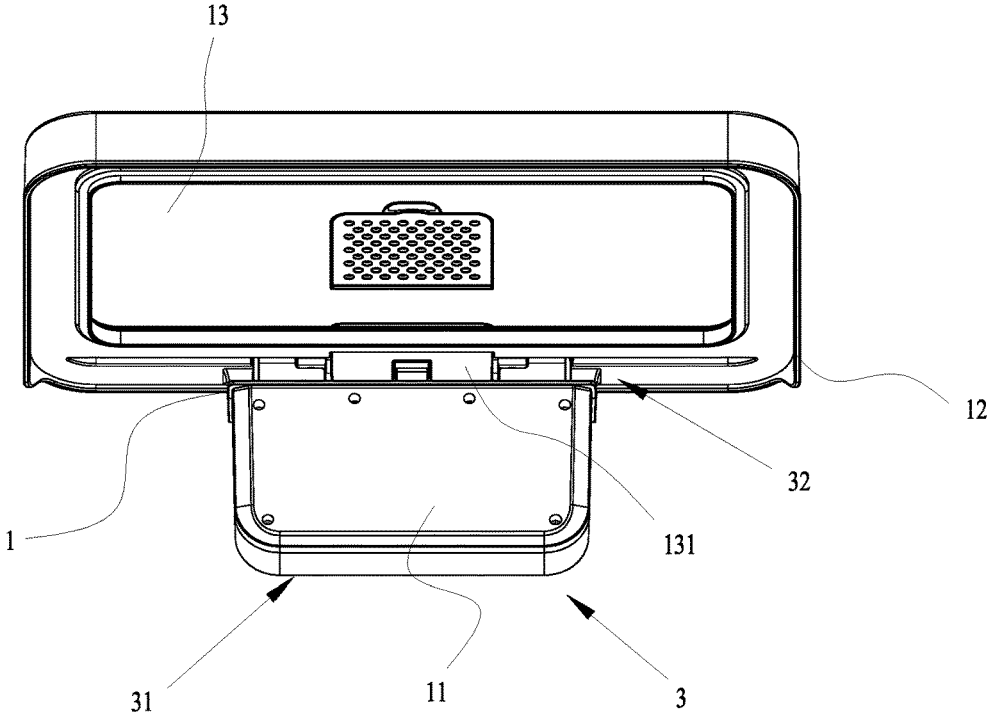
FIG. 1 is an oblique view of an inductive cover assembly according to an embodiment of the present disclosure.
Figure 2:
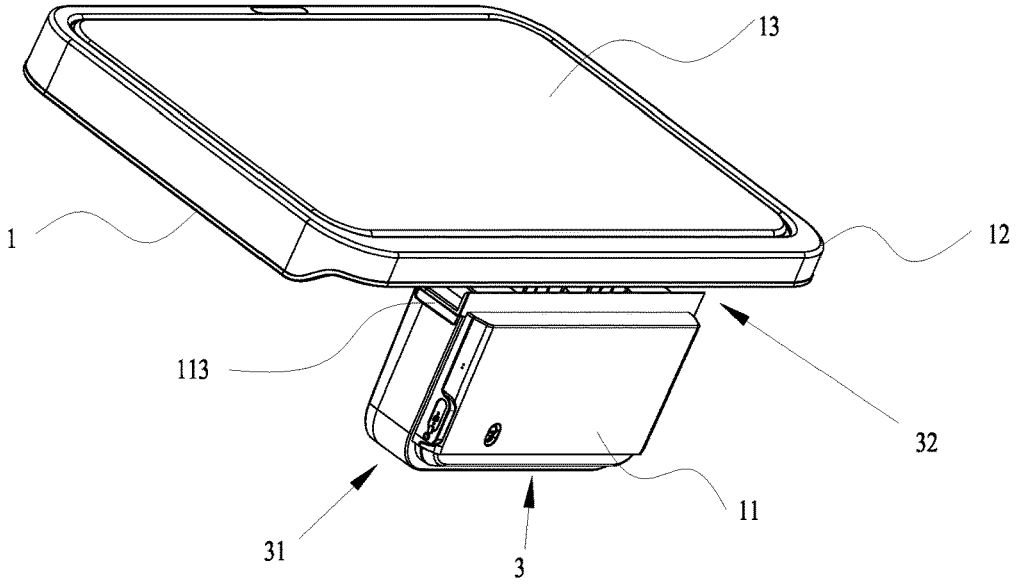
FIG. 2 is a schematic diagram of the inductive cover assembly according to an embodiment of the present disclosure.

In the drawings, 1, inductive cover assembly; 11, insert; 111, hinge shaft; 112, fixing block; 1121, fixing part; 1122, blocking part, 1123, connecting hole; 1124, threading hole; 113, locating groove; 114, actuating assembly; 1141, power supply module; 1142, actuating unit; 1143, speed reducer; 1144, connector; 1145, control circuit board; 115, push block; 1151, connecting part; 1152, mounting part; 116, torsion spring; 12, inductive ring; 121, first opening; 122, hinge block; 1221, locating part; 123, through hole; 124, connecting groove; 1241, second opening; 13, cover; 131, hinge seat; 1311, notch; 1312, connecting shaft; 2, main body; 21, can body; 211, first cavity; 2111, third opening; 212, assembly groove; 2121, recessed groove; 2122, fifth opening; 213, slide hole; 214, locking member; 2141, toggle block; 22, inner container; 221, second cavity; 222, fourth opening; 3, casing; 31, insert end; 32, hinge end.

DETAILED DESCRIPTION OF EMBODIMENTS

The application will be further described in detail with reference to the accompanying embodiments.

As shown in FIGS. 1-3 and 14-17, illustrated is an inductive cover assembly 1. The inductive cover assembly 1 is connected to a can body 21 of a trash can, and a side of the can body 21 is provided with an assembly groove 212 extending downward.

The inductive cover assembly includes an insert 11, an inductive ring 12 and a cover 13. The insert 11 is pluggably connected to the assembly groove 212, so as to allow the inductive cover assembly 1 to be detachably arranged on the can body 21. The insert 11 includes a casing 3 and an actuating assembly 114 that is arranged in the casing 3. The casing 3 of the insert 11 is detachably arranged on the can body 21, which facilitates the detachable connection of the insert 11 and the can body 21. The inductive ring 12 is hinged to the insert 11, and the inductive ring 12 is a ring structure and has a first opening 121. The cover 13 is arranged at the first opening 121 of the inductive ring 12, and is hinged to the insert 11, so that the cover 13 and the can body 21 form a sealed structure.

Figure 3:
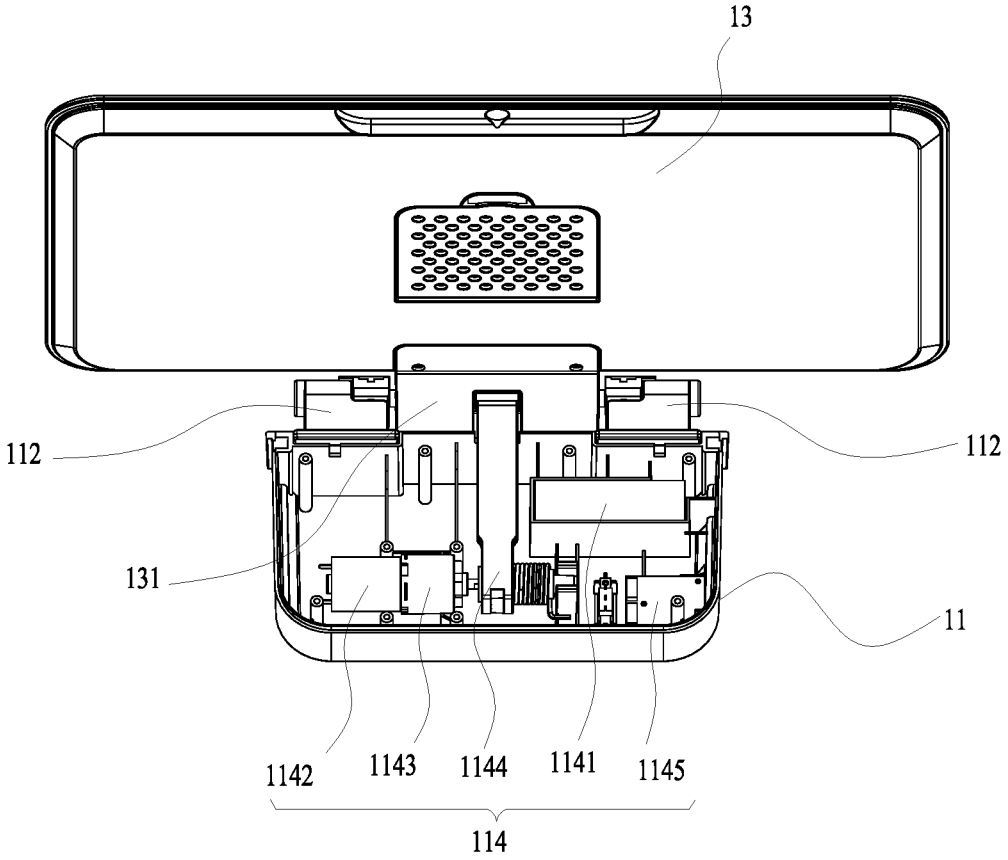
FIG. 3 shows the connection between an insert and a cover according to an embodiment of the present disclosure.

As shown in FIG. 3, the casing 3 of the insert 11 includes an insert end 31 and a hinge end 32. The insert end 31 is arranged at a lower end of the hinge end 32, and is detachably arranged on the can body 21. The hinge end 32 is hinged to the inductive ring 12 and the cover 13, respectively, and a hinge axis of the hinge end 32 and the inductive ring 12 is the same as that of the hinge end 32 and the cover 13. The inductive ring 12 and the cover 13 are turnable with respect to the insert 11. The inductive ring 12 is arranged between the cover 13 and the can body 21, and an angle of the inductive ring 12 with respect to the insert is limited by a position of the cover 13.

Figure 4:
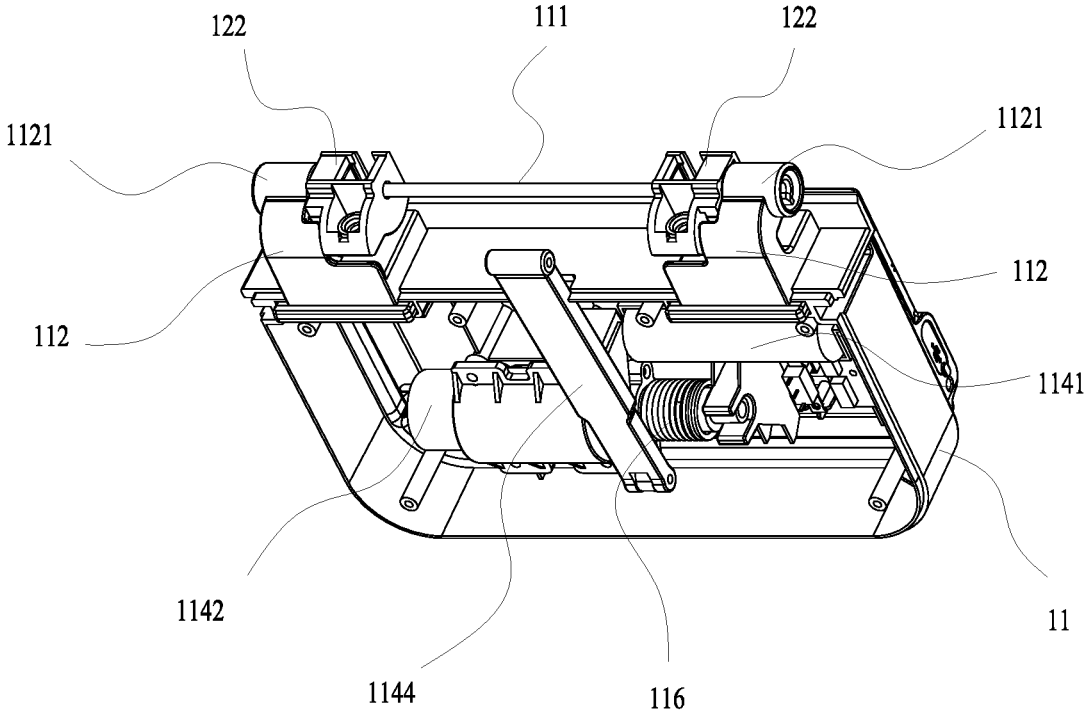
FIG. 4 shows an internal structure of the insert according to an embodiment of the present disclosure.
Figure 18:
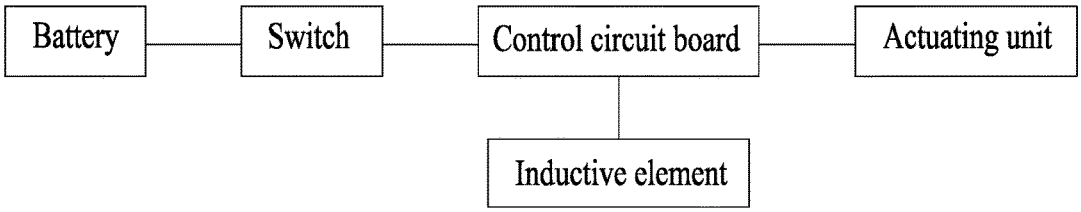
FIG. 18 shows the principle of an inductive circuit according to an embodiment of the present disclosure.

As shown in FIGS. 4 and 18, the actuating assembly 114 includes a power supply module 1141, an actuating unit 1142, a speed reducer 1143 and a connector 1144 that are arranged in the insert 11. The actuating assembly 114 is arranged in the insert 11 instead of the inductive ring 12 or the can body 21 of the trash can, which reduces the thickness of the inductive ring 12 or the can body 21, and makes the trash can simple and fashionable.

In some embodiments, the power supply module 1141 is a battery and is configured to supply power for the actuating unit to drive the actuating unit 1142 to rotate. An input shaft the speed reducer 1143 is connected to an output shaft of the actuating unit 1142. An end of the connector 1144 is connected to an output shaft of the speed reducer 1143, and the other end of the connector 1144 is connected to the cover 13. The actuating unit 1142 drives the connector 1144 to rotate through the rotation of the speed reducer 1143, thereby driving the cover 13 to rotate around the insert 11. Specifically, the actuating unit 1142 drives the speed reducer 1143 to work under the control of a control circuit board 1145. The speed reducer 1143 reduces the speed and increases the output torque at the same time to drive the connector 1144 to rotate, so as to open or close the cover 13.

As shown in FIGS. 3 and 4, the power supply module 1141 is arranged in an end of the insert 11, and the control circuit board 1145 and the actuating unit 1142 are arranged in the insert 11. The control circuit board 1145 and the actuating unit 1142 are electrically connected. A switch is provided between the power supply module 1141 and the control circuit board 1145.

The inductive ring 12 is provided with an inductive circuit which extends along a circumference of the inductive ring 12 and is connected to the control circuit board 1145. The inductive circuit has a plurality of inductive elements, such as infrared sensors, laser sensors, radar sensors. The inductive elements are arranged on an end of the inductive ring 12 away from the insert 11. The inductive elements are configured to identify signals that control on/off of the cover 13, and transmit the signals to the control circuit board 1145. The control circuit board 1145 controls the actuating unit 1142 to rotate according to the signals identified by the inductive elements, so as to open or close the cover.

As shown in FIGS. 3 and 4, the inductive cover assembly 1 further includes a hinge shaft 111, a hinge seat 131 and a hinge block 122. The hinge shaft 111 is fixedly arranged on the hinge end 32 of the insert 11. The cover 13 is connected to the hinge seat 131 which is rotatably connected to the hinge shaft 111, so that the cover 13 is rotatable around the hinge shaft 111. In an embodiment, there are two hinge blocks 122, and the inductive ring 12 is connected to the hinge block 122 which is rotatably connected to the hinge shaft 111, so that the inductive ring 12 is rotatable around the hinge shaft 111. The two hinge blocks 122 are arranged at both ends of the hinge seat 131. This configuration allows the inductive ring 12 and the cover 13 to be rotatable around the hinge shaft 111, respectively.

Figure 5:
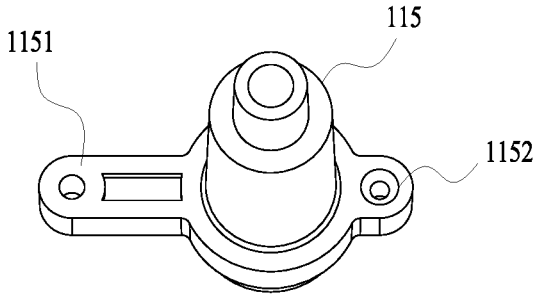
FIG. 5 is a schematic diagram of a push block according to an embodiment of the present disclosure.

As shown in FIGS. 3-5, a cylindrical push block 115 is arranged on an output shaft of the speed reducer 1143, and an end of the push block 115 close to the speed reducer 1143 is provided with a connecting part 1151 and a mounting part 1152 which extend in opposite directions from a circumference of the push block 115. An end of the connector 1144 is in transmission connection with the connecting part 1151, and the other end of the connector 1144 is in transmission connection with the hinge seat 131. The arrangement of the push block 115 facilitates the connection between the output shaft of the speed reducer 1143 and the connector 1144, so as to drive the connector 1144 to rotate.

As shown in FIG. 4, a torsion spring 116 is provided on the push block 115 and is configured to offset the gravity during the turning of the cover 13, so that the cover 13 can be slowly opened or closed.

Figure 6:
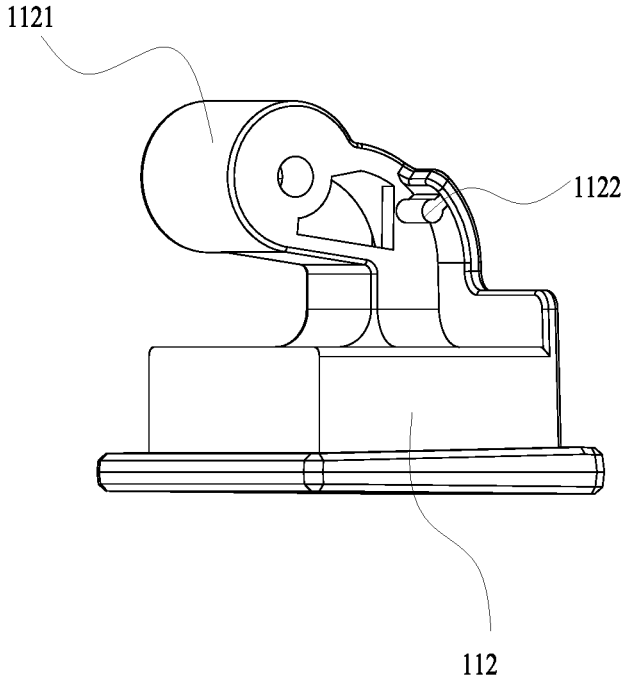
FIG. 6 is a schematic diagram of a fixing block according to an embodiment of the present disclosure.
Figure 7:
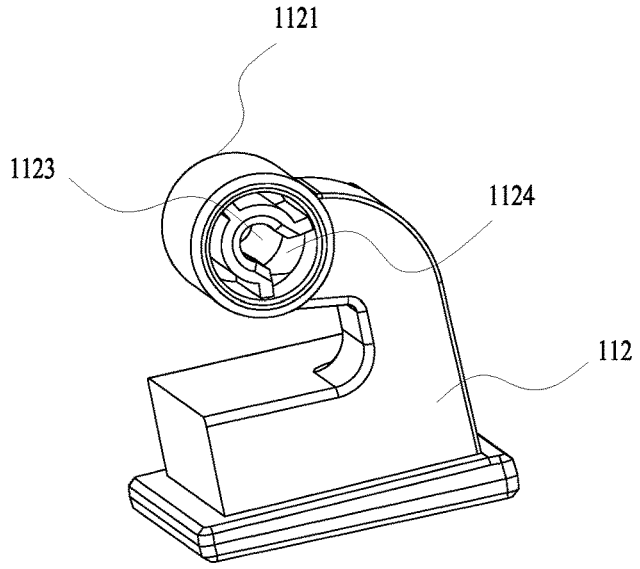
FIG. 7 is an oblique view of the fixing block according to an embodiment of the present disclosure.
Figure 8:
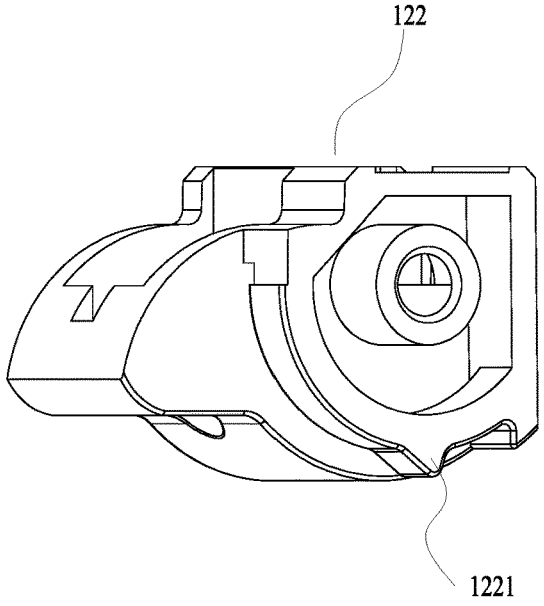
FIG. 8 is a schematic diagram of a hinge block according to an embodiment of the present disclosure.

As shown in FIGS. 6-8, the inductive ring 12 is turned to a preset angle to allow the inductive ring 12 to be open. In an embodiment, at least one fixing block 112 is provided on the hinge end 32, and an upper end of each fixing block 112 is provided with a fixing part 1121. The fixing parts 1121 are respectively connected to the hinge shaft 111 to fix the hinge shaft 111 on the hinge end 32 of the insert 11. A blocking part 1122 that is horizontally arranged is provided on a side of the fixing block 112 close to the hinge block 122. A locating part 1221 is provided on a side of the hinge block 122 close to the blocking part 1122 along a rotation direction of the hinge block 122. The inductive ring 12 rotates around the hinge shaft 111, and when the locating part 1221 and the blocking part 1122 are connected, the inductive ring 12 is opened.

In some embodiments, the hinge end 32 is provided with two fixing blocks 112, and an upper end of each of the two fixing blocks 112 is provided with a fixing part 1121. The two fixing parts 1121 are respectively connected to two ends of the hinge shaft 111 to fix the hinge shaft 111 to the hinge end 32 of the insert 11. A blocking part 1122 is provided on a side of the fixing block 112 close to the hinge block 122 along a horizontal direction. A locating part 1221 is provided on a side of the hinge block 122 close to the blocking part 1122 along a rotation direction of the hinge block 122. The hinge block 122 rotates upward around the hinge shaft 111 until the locating part 1221 is connected to the blocking part 1122, so that the inductive ring 12 is in a fixed state. When the inductive cover assembly 1 is arranged on the can body 21, this configuration allows the inductive ring 12 to be turned to a preset angle, which facilitates the replacement of trash bags. After the replacement, the inductive ring 12 is turned downward to disconnect the locating part 1221 from the blocking part, and then the inductive ring 12 can be rotated to connect with the can body 21. Thus, the trash can with such configuration is convenient to use.

Figure 10:
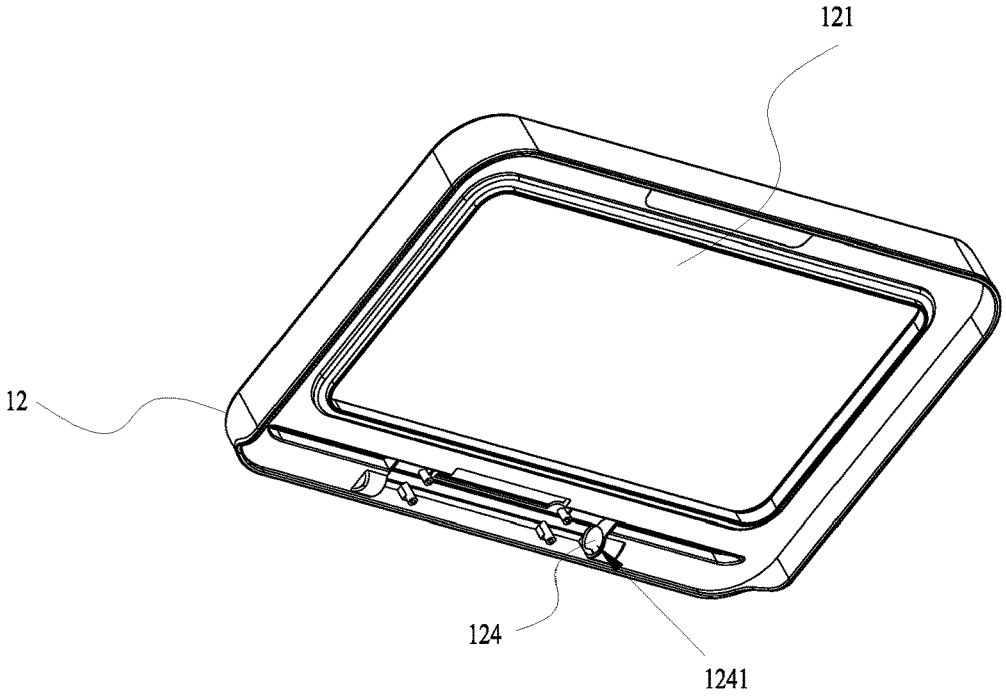
FIG. 10 is an oblique view of the inductive ring according to an embodiment of the present disclosure.

As shown in FIGS. 7 and 10, the hinge shaft 111 extends horizontally, and each of the fixing parts 1121 is provided with a connecting hole 1123 which penetrates through the fixing part 1121 along an extension direction of the hinge shaft 111. An end of the hinge shaft 111 extends into the connecting hole 1123 to connect the fixing part 1121. An end of the inductive ring 12 close to the insert 11 is provided with a connecting groove 124 corresponding to the fixing part 1121. The connecting groove 124 is provided with a second opening 1241 extending horizontally. The fixing part 1121 extends into the connecting groove 124 and is rotatably connected to the inductive ring 12, and the connecting hole 1123 is communicated to the connecting groove 124. An inner wall of the connecting hole 1123 is provided with a threading hole 1124 which faces the inner side of the fixing part 1121 and is communicated to an external environment. The inductive circuit is arranged circumferentially around the inductive ring 12 and is connected to the control circuit board 1145 of the insert 11 passing through the connecting groove 124, the connecting hole 1123 and the threading hole 1124 in sequence. This structure is convenient for the arrangement of electric wires, so that the inductive circuit is connected to the control circuit board 1145 in the insert 11.

Figure 9:
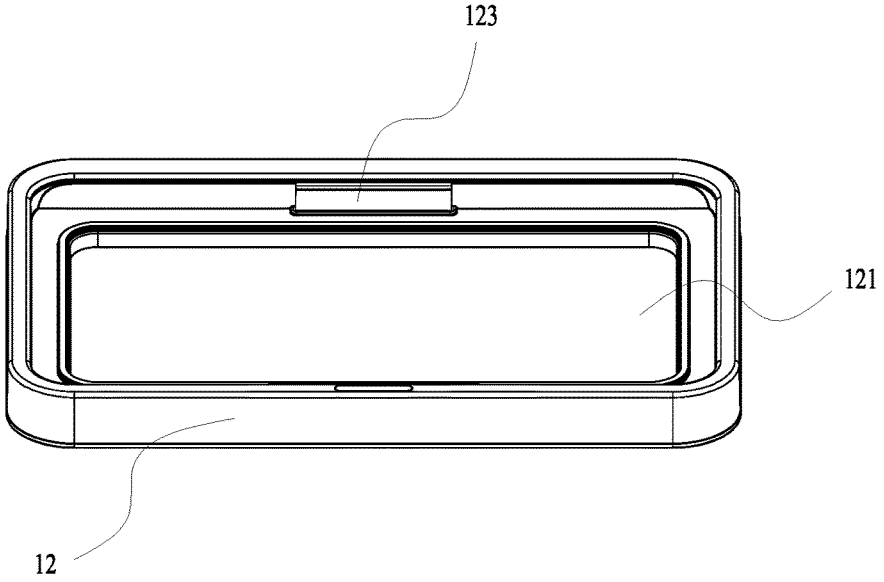
FIG. 9 is a schematic diagram of an inductive ring according to an embodiment of the present disclosure.
Figure 11:
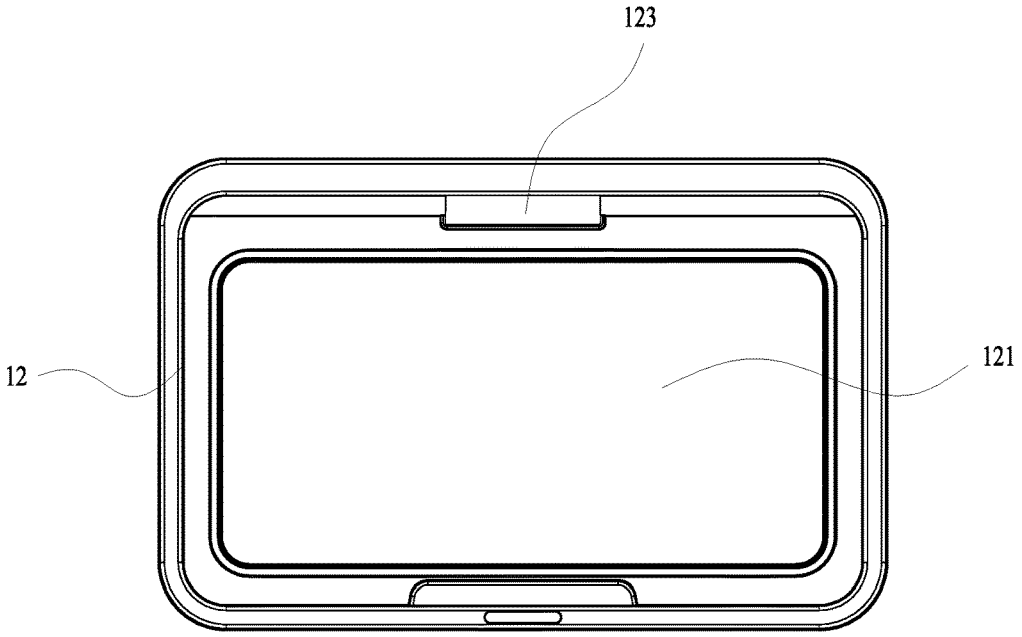
FIG. 11 is a top view of the inductive ring according to an embodiment of the present disclosure.

As shown in FIGS. 9-11, the first opening 121 of the inductive ring 12 fits the cover 13 in shape. An end of the inductive ring 12 close to the insert 11 is provided with a through hole 123 which penetrates through upper and lower surfaces of the inductive ring 12. An end of the hinge seat 131 away from the insert 11 passes through the through hole 123 and is connected to the cover 13, so that the inductive ring 12 and the cover 13 are hinged to the hinge end 32 of the insert 11, respectively. This structure enables the inductive ring 12 and the cover 13 to rotate independently with respect to the insert 11. The inductive ring 12 can remain stationary when the cover 13 rotates with respect to the insert 11.

Figure 12:
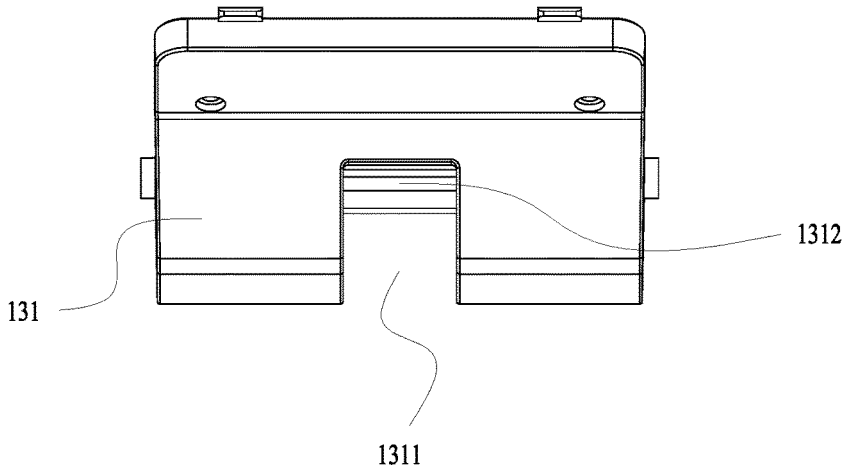
FIG. 12 is a schematic diagram of a hinge seat according to an embodiment of the present disclosure.
Figure 13:
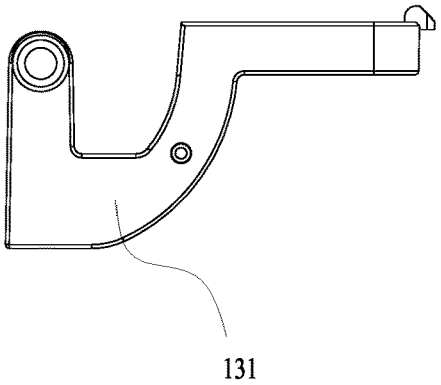
FIG. 13 is a left view of the hinge seat according to an embodiment of the present disclosure.

As shown in FIG. 12, a notch 1311 is provided on an end of the hinge seat 131 close to the insert 11, and a connecting shaft 1312 is provided in the notch 1311 along the horizontal direction. An end of the connector 1144 away from the actuating unit 1142 extends into the first notch 1311 and is hinged to the connecting shaft 1312. This structure makes the hinge seat 131 and the connector 1144 rotatably connected.

As shown in FIGS. 2 and 15-17, a recessed groove 2121 is provided on a side wall or two opposite side walls of the assembly groove 212. In an embodiment, two opposite side walls of the assembly groove 212 each are provided with a recessed groove 2121 communicated to the assembly groove 212. An upper surface of the can body 21 is provided with a slide hole 213 corresponding to the recessed groove 2121, and the slide hole 213 is communicated to the recessed groove 2121. A locking member 214 may be a locating pin which is provided on an inner surface of the recessed groove 2121. The locating pin is provided with a toggle block 2141. The toggle block 2141 passes through the slide hole 213 and extends out of the can body 21, and is capable of driving the locating pin to move along a length of the slide hole 213 with respect to the recessed groove 2121. The insert 11 is provided with a locating groove 113 corresponding to the locating pin 214. When the locating pin moves towards the assembly groove 212 and a long end face of the toggle block 2141 abuts against the slide hole 213, the slide hole 213 restricts the forward movement of the locating pin 214, and the locating pin is inserted into the locating groove 113. The insert 11 is inserted into the assembly groove 212, and the locating pin is connected to the locating groove 113 to lock the insert 11, so that the insert 11 is not easily detached from the can body 21.

Figure 14:
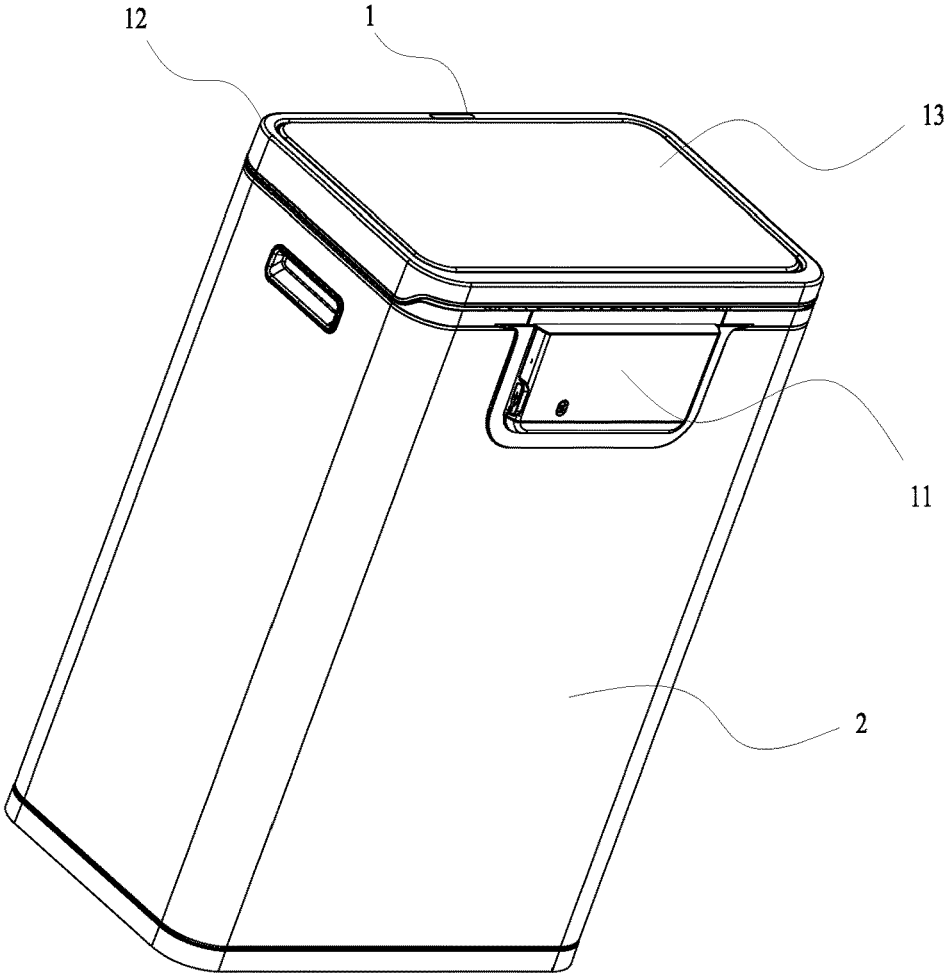
FIG. 14 is a schematic diagram of a trash can according to an embodiment of the present disclosure.
Figure 17:
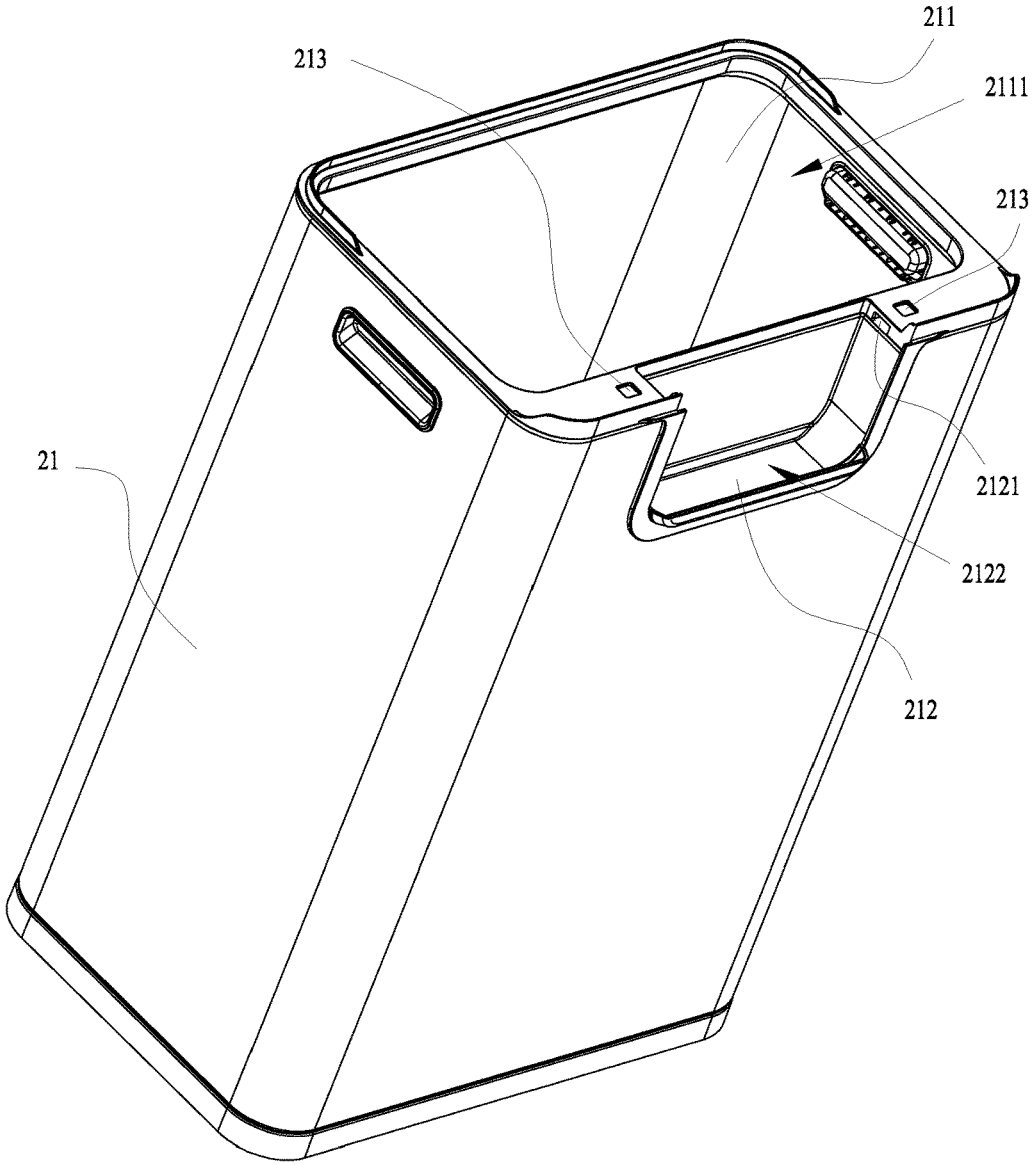
FIG. 17 is a schematic structural diagram of a can body according to an embodiment of the present disclosure.

As shown in FIGS. 14 and 17, the present disclosure further provides a trash can using the inductive cover assembly that includes a main body 2. The inductive cover assembly 1 is detachably arranged on the main body 2, and the main body 2 comprises a can body 21 and an inner container 22.

As shown in FIG. 17, the can body 21 is provided with a first cavity 211 having a third opening 2111 on an upper end surface.

Figure 15:
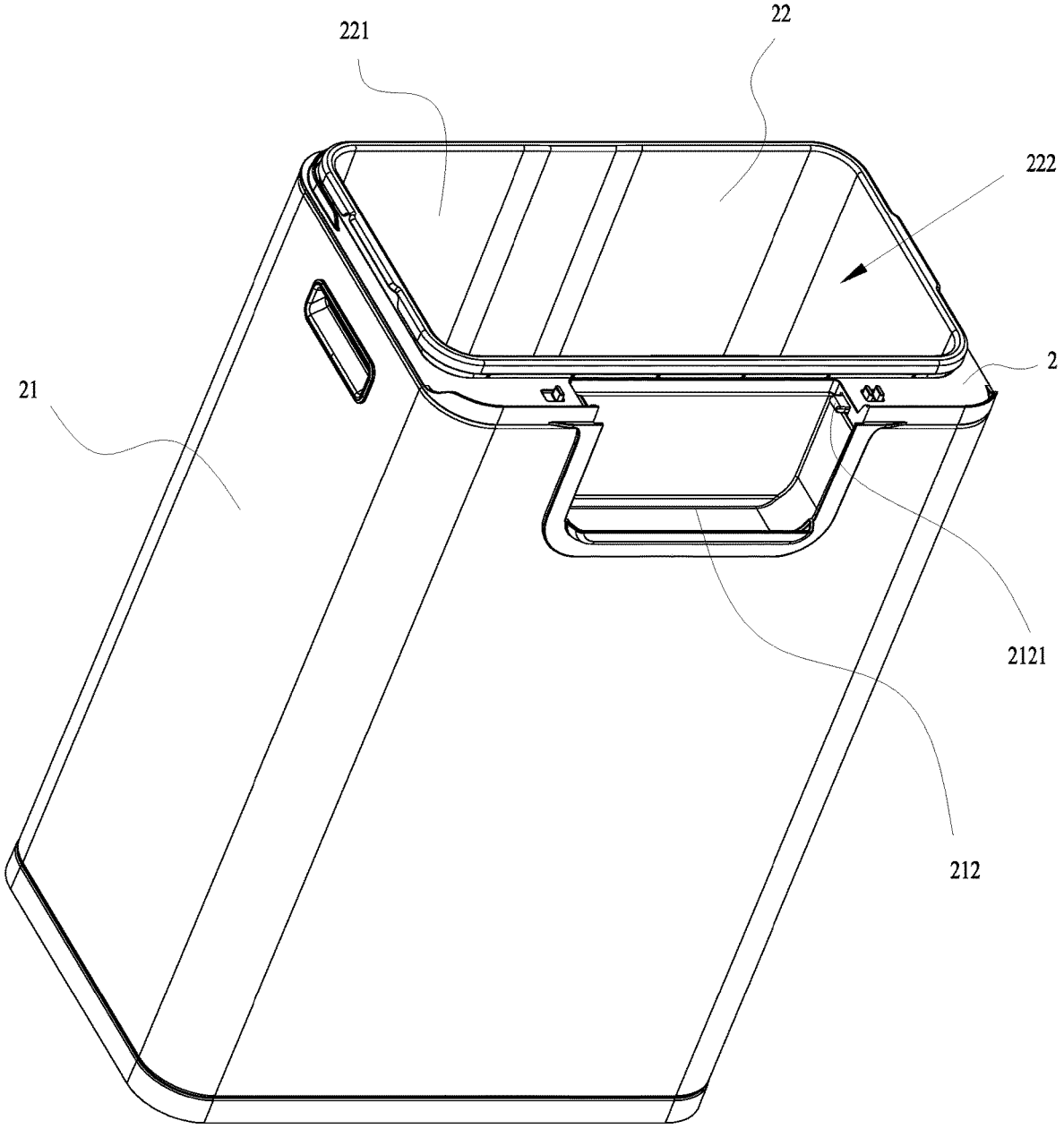
FIG. 15 is a schematic diagram of a main body of the trash can according to an embodiment of the present disclosure.
Figure 16:
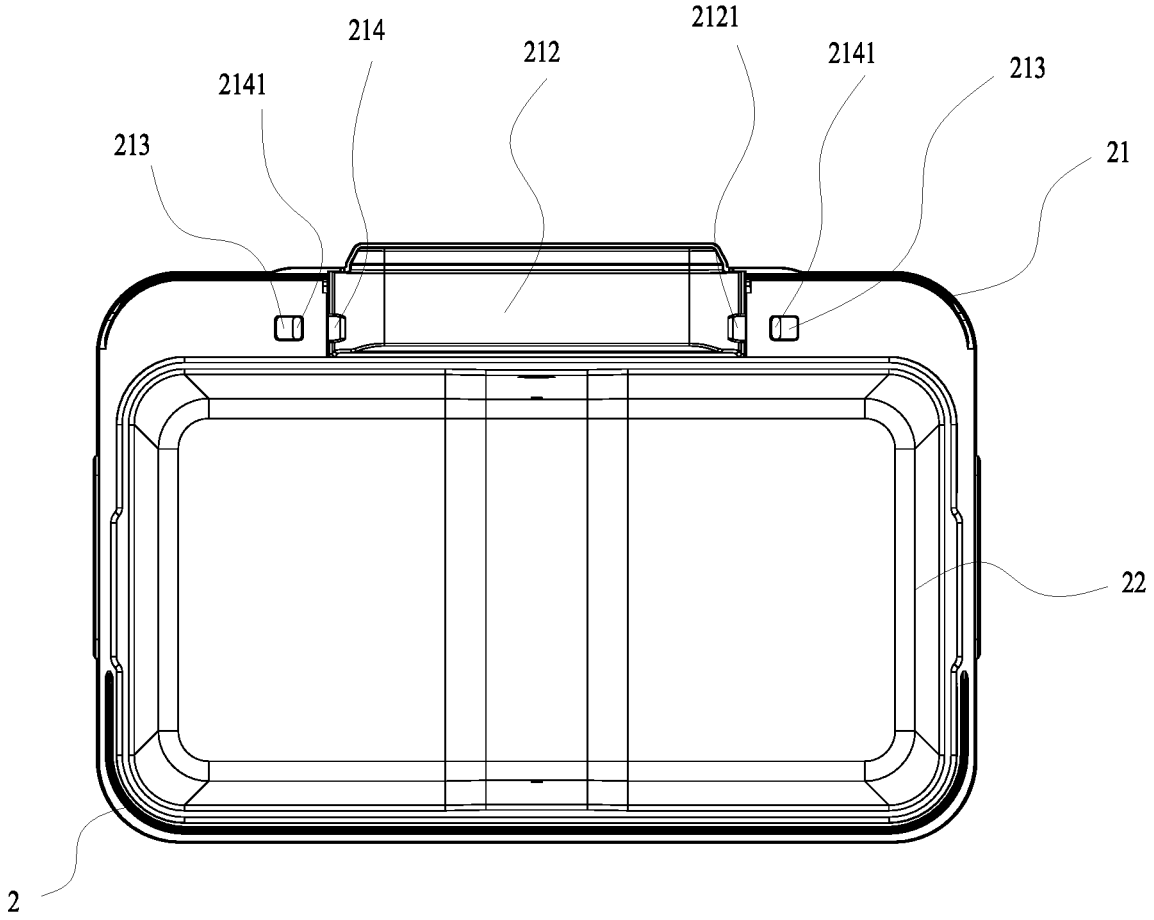
FIG. 16 is a top view of the main body of the trash can according to an embodiment of the present disclosure.

As shown in FIG. 15, the inner container 22 is arranged in the first cavity 211 of the can body 21 through the third opening 2111, and an upper end of the inner container 22 protrudes from that of the can body 21. The inner container 22 is provided with a second cavity 221 for accommodating trash and a fourth opening 222, and the fourth opening 222 is communicated to the second cavity 221 and is located at the upper end of the inner container 22. The trash enters the inner cavity 221 through the fourth opening 222 of the inner container 22. The second cavity 221 accommodates trash. When a trash bag is placed in the inner container, the trash enters the trash bag through the fourth opening 222 of the inner container 22.

As shown in FIGS. 14-17, the assembly groove 212 has a fifth opening that is arranged upward and is provided on an upper end of the can body 21. The casing 3 of the insert 11 extends into the assembly groove 212 through the fifth opening 2122 and is connected to the assembly groove 212, which makes the inductive cover assembly 1 and the main body 2 connected to form a trash can. The inductive ring 12 and the cover 13 can be turned around the hinge shaft 111 with respect to the main body 2. The inductive ring 12 can remain stationary when turning to the preset angle, which facilitates the replacement of the trash bag. When the replacement is completed, the inductive ring 12 can be turned to connect the can body 21, which is convenient to use. In this way, there is no need to remove the inductive cover assembly during the replacement of trash bags.

The above are only the preferred embodiments of the present disclosure, and are not intended to limit the scope of the present disclosure. Any changes, equivalent modifications and improvements made by those skilled in the art without departing from the spirit of the present disclosure shall fall within the scope of the present disclosure.

What is claimed is:

1. An inductive cover assembly, the inductive cover assembly operable to be connected to a can body of a trash can, a side of the can body being provided with an assembly groove extending downward, the inductive cover assembly comprising:

an insert, comprising a casing and an actuating assembly arranged in the casing, wherein the insert is pluggably connected to the assembly groove to allow the inductive cover assembly to be detachably arranged on the can body;

an inductive ring, having a first opening and hinged to the insert; and a cover, covering the first opening of the inductive ring and hinged to the insert;

the casing of the insert is detachably arranged on the can body and comprises an insert end and a hinge end; the insert end is arranged at a lower end of the hinge end, and is detachably arranged in the can body; the hinge end is hinged to the inductive ring and the cover, respectively, and a hinge axis of the hinge end and the inductive ring is the same as that of the hinge end and the cover; the inductive ring and the cover are rotatable with respect to the insert; the inductive ring is arranged between the cover and the can body, and an angle of the inductive ring with respect to the insert is limited by a position of the cover; the inductive ring is in an open position when it is turned to a preset angle;

the actuating assembly comprises a power supply module, an actuating unit, a speed reducer and a connector that are arranged in the insert; the power supply module is connected to the actuating unit through a control circuit board, and is configured to supply power for the actuating unit; the control circuit board is configured to control the actuating unit to rotate; an input shaft of the speed reducer is connected to an output shaft of the actuating unit; an end of the connector is connected to an output shaft of the speed reducer, and the other end of the connector is connected to the cover; the actuating unit drives the connector to rotate through the speed reducer, so that the cover is driven to rotate around the insert; the inductive ring is provided with an inductive circuit which extends along a circumference of the inductive ring and is connected to the control circuit board; the inductive circuit comprises a plurality of inductive elements which are configured to identify a signal for opening or closing the cover and transmit the signal to the control circuit board; and the control circuit board controls the actuating unit to rotate according to the signal identified by the inductive elements.

2. The inductive cover assembly of claim 1, further comprising a hinge shaft, a hinge seat and a plurality of hinge blocks; wherein the hinge shaft is arranged on the hinge end of the insert; the cover is connected to the hinge seat which is rotatably connected to the hinge shaft, so that the cover is rotatable around the hinge shaft; the inductive ring is connected to the hinge blocks which are rotatably connected to the hinge shaft, so that the inductive ring is rotatable around the hinge shaft; and the hinge blocks are arranged at both ends of the hinge seat.

3. The inductive cover assembly of claim 2, wherein the first opening of the inductive ring fits the cover in shape; an end of the inductive ring close to the insert is provided with a through hole penetrating through upper and lower surfaces of the inductive ring; an end of the hinge seat away from the insert passes through the through hole and is fixedly connected to the cover, so that the inductive ring and the cover are hinged to the hinge end of the insert, respectively; a notch is provided on an end of the hinge seat close to the insert, and a connecting shaft is provided in the notch along a length of the hinge seat; and an end of the connector away from the actuating unit extends into the notch and is hinged to the connecting shaft.

4. The inductive cover assembly of claim 3, wherein a fixing block is provided on the hinge end, and an upper end of the fixing block is provided with a fixing part; the fixing part is connected to the hinge shaft to fix the hinge shaft on the hinge end of the insert; a blocking part that is arranged along the length of the hinge seat is provided on a side of the fixing block close to the hinge block; a locating part is provided on a side of the hinge block close to the blocking part along a rotation direction of the hinge block; and the inductive ring rotates around the hinge shaft, and when the locating part is connected to the blocking part, the inductive ring is opened.

5. The inductive cover assembly of claim 4, wherein the hinge shaft extends horizontally, and the fixing part is provided with a connecting hole along a length of the hinge shaft; the connecting hole penetrates through the fixing part, and an end of the hinge shaft extends into the connecting hole to connect the fixing part; an end of the inductive ring close to the insert is provided with a connecting groove corresponding to the fixing part, and the connecting groove is provided with a second opening extending horizontally; the fixing part extends into the connecting groove and is rotatably connected to the inductive ring, and the connecting hole is communicated to the connecting groove; an inner wall of the connecting hole is provided with a threading hole communicated to an external environment; and the control circuit board is arranged in the insert, and the inductive circuit is arranged circumferentially around the inductive ring and passes through the connecting groove, the connecting hole and the threading hole in sequence, and then is connected to the control circuit board arranged in the insert.

6. The inductive cover assembly of claim 1, wherein a recessed groove is provided on a side wall or two opposite side walls of the assembly groove, and the recessed groove is communicated to the assembly groove; and an upper surface of the can body is provided with a slide hole corresponding to the recessed groove, and the slide hole is communicated to the recessed groove.

7. The inductive cover assembly of claim 6, wherein a locking member is provided on an inner surface of the recessed groove; the locking member is a locating pin provided with a toggle block which passes through the slide hole and extends out of the can body; the toggle block drives the locating pin to move along the slide hole with respect to the recessed groove; the insert is provided with a locating groove corresponding to the locating pin; and when the locating pin moves towards the assembly groove and a long end face of the toggle block abuts against the slide hole, the slide hole restricts the forward movement of the locating pin, and the locating pin is inserted into the locating groove.

8. The inductive cover assembly of claim 1, wherein the power supply module and the control circuit board are arranged in the insert; and the actuating unit is arranged on a side of the control circuit board and is electrically connected to the control circuit board.

9. The inductive cover assembly of claim 8, wherein a push block which is cylindrical is arranged on an output shaft of the speed reducer, and an end of the push block close to the speed reducer is provided with a connecting part and a mounting part; the connecting part and the mounting part extend in opposite directions from a circumference of the push block; and the connector is in transmission connection with the connecting part, and a torsion spring is arranged on the push block and configured to offset the gravity during the turning of the cover.

10. A trash can using the inductive cover assembly of claim 1, comprising a main body; wherein the inductive cover assembly is detachably arranged on the main body;

the main body comprises a can body and an inner container;

the can body is provided with a first cavity that comprises a third opening on an upper end surface; the inner container is arranged in the first cavity of the can body through the third opening, and an upper end of the inner container protrudes from that of the can body; the inner container is provided with a second cavity for accommodating trash and a fourth opening, and the fourth opening is communicated to the inner cavity and is located at the upper end of the inner container; and the trash enters the second cavity through the fourth opening; and the assembly groove having a fifth opening that is arranged upward is arranged on an upper end of the can body; and the casing of the insert is inserted into the assembly groove through the fifth opening.

* * * * *